US005911311A

United States Patent [19]

Hutchins

[11] Patent Number: 5,911,311

[45] Date of Patent: Jun. 15, 1999

[54] BIB HAVING DETACHABLE PROTECTION PANELS

[76] Inventor: Debra Hutchins, 26 Alamosa Dr., Trophy Club, Tex. 76262

[21] Appl. No.: 08/917,191

[22] Filed: Aug. 25, 1997

[51] Int. Cl.[6] ..... A41B 13/10; A41D 11/00

[52] U.S. Cl. ..... 2/49.5; 2/49.4; 2/49.1; 2/48

[58] Field of Search ..... 2/46, 49.1, 49.2, 2/49.3, 49.4, 49.5, 50, 51, 52, 174, 105, 106, 104, 115, 113, 114, 69, 69.5, 75, 80, 455

[56] References Cited

U.S. PATENT DOCUMENTS

| | | | |
|---|---|---|---|
| 2,244,656 | 6/1941 | Asch | 2/49.5 |
| 3,540,060 | 11/1970 | Brown . | |
| 4,862,518 | 9/1989 | Williams et al. . | |
| 5,432,952 | 7/1995 | Tate . | |
| 5,454,119 | 10/1995 | Thomm . | |
| 5,490,289 | 2/1996 | Lehrer | 2/49.5 X |
| 5,640,715 | 6/1997 | Adams | 2/49.5 X |

FOREIGN PATENT DOCUMENTS

| | | | |
|---|---|---|---|
| 1521532 | 4/1968 | France | 2/49.5 |
| 1560609 | 3/1969 | France | 2/49.5 |
| 749066 | 5/1956 | United Kingdom | 2/49.5 |
| 921940 | 3/1963 | United Kingdom | 2/49 |

*Primary Examiner*—Jeanette Chapman
*Attorney, Agent, or Firm*—Terrance L. Siemens

[57] ABSTRACT

A bib having plural manually removable protective panels. The bib has a base panel and a tie for tying the base panel around the neck of a wearer. The base panel has a male snap located at each of its right and left upper corners. Each removable protective panel has a profile corresponding to that of the base panel, and hence right and left upper corners alignable with those of the base panel. A female snap is disposed on the rear surface of each removable panel at each upper corner thereof. Each female snap is two sided, having a male snap disposed on the front surface of each removable panel. This enables removable panels to be fastened in stacked fashion to the base panel. In an alternative embodiment, the snaps are replaced by hook and loop fasteners. Optionally, a top protective panel is provided having snaps attachable only on one side, a finished surface being exposed on the opposite side.

7 Claims, 3 Drawing Sheets

BIB HAVING DETACHABLE PROTECTION PANELS

BACKGROUND OF THE INVENTION

1. Field of the Invention

The present invention relates to protective bibs for infants. More particularly, the invention comprises a bib adapted to enable a succession of protective bib panels to be manually removed from the bib, each panel revealing an underlying panel when removed.

2. Description of the Prior Art

Feeding of infants and babies can be quite messy, since the young are unable to maintain order while eating, and since foods prepared for infants are often in liquid or fluent form. To protect a child's clothing against soiling from spills, drooling, and the like, the child is typically provided with a bib. The bib may be removed after feeding is finished. However, the volume of spillage may well exceed the capacity of a bib to absorb spillage during only one feeding. More than one bib may be required to complete a feeding.

A bib providing progressive layers of protection is shown in U.S. Pat. No. 5,432,952, issued to Kathleen M. Tate on Jul. 18, 1995. Although redundant or plural protective panels are provided, they are not separable in the manner of the present invention.

A similar concept is employed in a jacket set forth in U.S. Pat. No. 5,454,119, issued to Joyce M. Thomm on Oct. 3, 1995. Although the jacket has a removable bib member, there is no provision for more than one bib member, unlike the present invention.

U.S. Pat. No. 3,540,060, issued to Grace Wallace Brown on Nov. 17, 1970, describes a bib having a removable front panel. Although the front panel removes with snaps, the snaps are not arranged to enable a plurality of removable front panels to be stacked in the manner of the present invention.

A compound bib having plural protective members is seen in U.S. Pat. No. 5,432,952, issued to Kathleen M. Tate on Jul. 18, 1995. However, the plural members are not removable and also do not provide virtually identical protective coverage, these characteristics being found in the present invention.

None of the above inventions and patents, taken either singly or in combination, is seen to describe the instant invention as claimed.

SUMMARY OF THE INVENTION

The present invention provides a bib having a permanent protective panel and a plurality of removable panels disposed in stacked fashion above the permanent panel. Each removable panel has fasteners of opposed polarity or type on each side. In this manner, additional similar panels can be fastened in stacked fashion to that already fastened to the permanent panel.

The novel arrangement allows a user to detach and discard the exposed protective panel when saturated with spillage. Another protective panel is then exposed and can maintain protection of the child and the child's clothes. This process may continue for a prolonged period of time so that one bib will provide adequate protection for even a prolonged feeding. The removed protective panels may be laundered and reassembled for a subsequent use.

Fasteners may be of any suitable type, including two headed snaps and corresponding hook and loop fastening material. Each fastener, regardless of type, has a female member on the back side, that being the side which contacts or faces the permanent bib protective panel, and a male member on the front. The fasteners are all located in corresponding places on each protective panel, so that any number of panels may be fastened in stacked fashion.

The bib includes a permanent protective panel and a tie for tying around the baby's neck. Two tabs each having a snap are fastened to the permanent panel, and snap over the topmost, exposed snaps of the stacked removable panels.

Accordingly, it is a principal object of the invention to provide a bib having plural protective panels.

It is another object of the invention that the removable panels be manually removable and replaceable on the bib.

It is a further object of the invention that the novel bib accommodate more than one removable panel.

Still another object of the invention is to provide manual fasteners of opposite polarity at overlying positions on each side of each one removable protective panel.

An additional object of the invention is to provide a tab fastening to and covering an otherwise exposed fastener of the topmost protective panel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
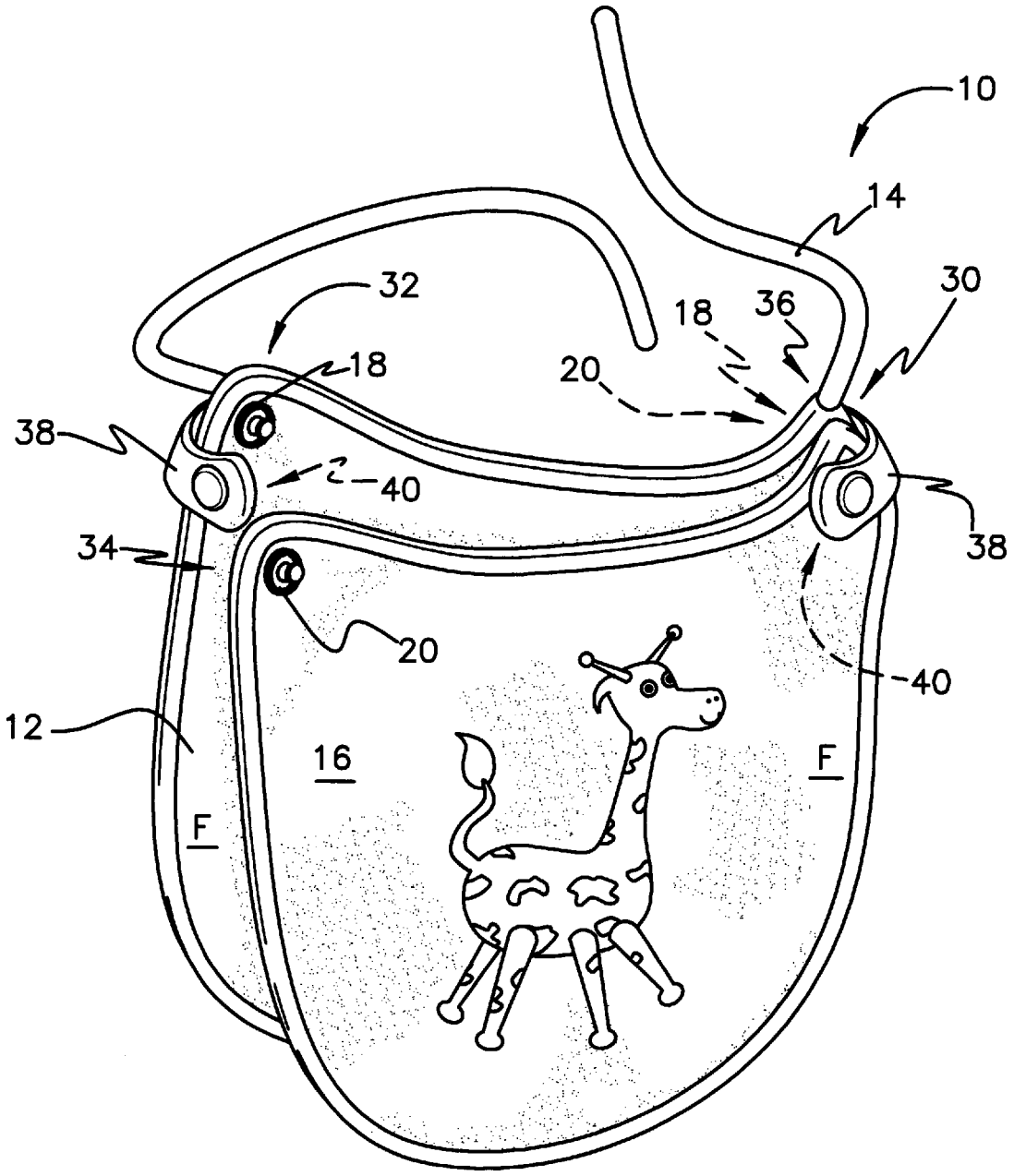
FIG. 1 is a front perspective view of the invention, showing one protective panel partially attached to the novel bib.

Turning now to FIG. 1 of the drawings, bib 10 is seen to comprise a base panel 12 having a front side F and a rear side R, a tie 14 fastened to base panel 12, for securing said bib to the neck of a wearer, and a removable panel 16. Base panel 12 is flexible and may be fabricated from a liquid absorbent material, such as terrycloth, or alternatively comprises or is coated with a synthetic resin so that stains and spillage do not permeate base panel 12. Removable panel 12 is both flexible and liquid absorbent, so as to entrap fluent materials. Tie 14 is a cord or any suitable member which can encircle the neck of a wearer and be fastened by tying, by joining fasteners (not shown), or in any other suitable manner. Tie 14 may be stitched or adhered to panel 12, entrapped within a hem (not shown) formed in panel 12, or otherwise secured to panel 12.

Figure 2:
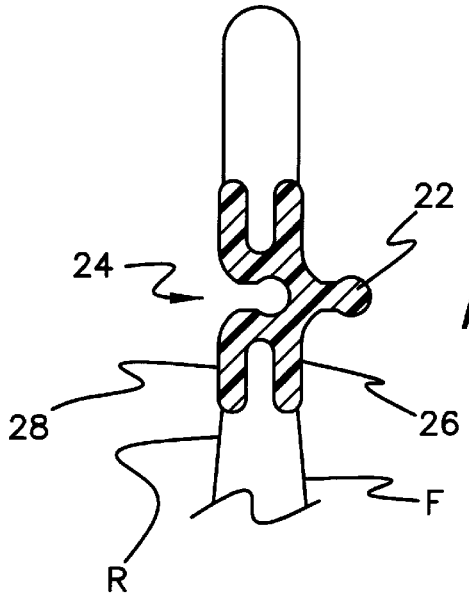
FIG. 2 is a side cross sectional detail view of a two sided snap employed in the protective panel of FIG. 1, drawn to enlarged scale.

Removable panel 16 manually fastens to and is removable from base panel 12 by snaps 18, 20. Snaps 18 are preferably snap fasteners each having a male member for penetrating and engaging a corresponding female member or socket formed in a separate, corresponding snap 20. Snap 20, shown in detail in FIG. 2, is a two sided snap including one male snap having a male member 22 and one female snap having a corresponding female member or socket 24 for receiving a male member 22. Snaps 20 further comprise flanges 26, 28 which surround and retain fabric material on which snaps 18 and 20 are mounted. Snaps 18 include equivalent flanges (not shown).

Although base panel 12 may have only one snap 18, it is preferable that two snaps 18 be provided in horizontally spaced apart relationship. Snaps 20 of removable panel 16 correspond to snaps 18 of base panel 12, there being one snap 20 for each snap 18. Snaps 20 are arranged on removable panel 16 such that when removable panel 16 is place over and spread out flat on base panel 12, snaps 18 and 20 are in overlying relationship. Base panel 12 and removable panel 16 are thus able to be disposed parallel to one another when worn, so as to be compact, comfortable, and as unobtrusive as is feasible.

The male connector of each snap 18 is disposed upon the front side F of base panel 12. Designation of the front side F of panels 12 and 16 is for semantic purposes only in clarifying attachment of panel 16 to panel 12. It is intended that more than one removable panel 16 be provided, to enable a person to periodically peel away or remove successive removable panels 16 in the course of one feeding or other usage of bib 10. For this reason, nature and arrangement of snaps 20 is critical. Snaps 20 are arranged both to overly and also to be fastenably compatible with their respective corresponding snaps 18, as shown in FIG. 1. This requires the arrangement of two sided snaps 20, wherein a male member 22 is disposed on one side of a removable panel 16 and a socket 24 is disposed on the other side of panel 16 in a location directly opposed to or overlying male member 22.

Figure 3:
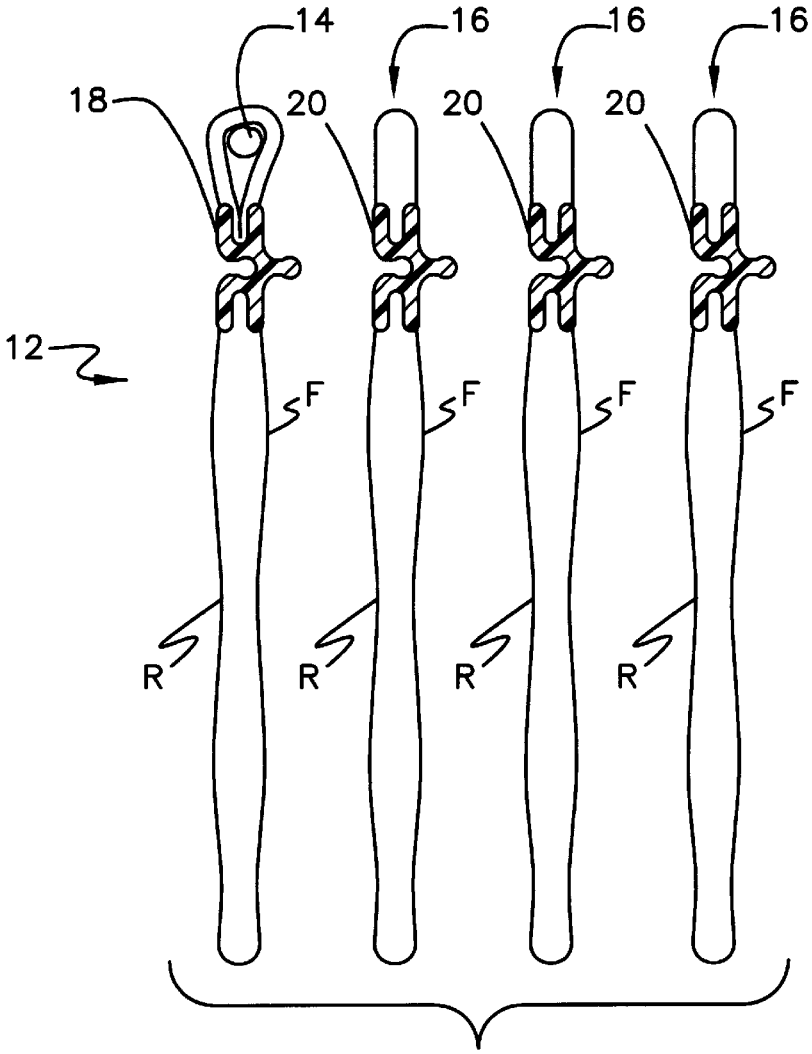
FIG. 3 is an exploded side cross sectional view illustrating a plurality of protective panels as they might be stacked for stacked attachment to a base panel shown in FIG. 1.

In summary, each removable panel 16 has one fastener fastenably compatible with its corresponding fastener of base panel 12 and a fastener configured similarly to the fastener of base panel 12. Preferably, base panel 12 has two fasteners, each removable panel 16 having two corresponding fasteners horizontally spaced apart from one another by a distance equal to that separating the two fasteners of base panel 12. Thus, removable panels 16 may be suspended fully spread open when fastened to base panel 12. All fasteners, when base panel 12 and removable panels 16 are placed in overlying relationship, are accordingly disposed in overlying relationship. This arrangement enables a plurality of removable panels 16 to be fastened to base panel 12 in stacked fashion, as shown in FIG. 3, while being individually removable from each other and from base panel 12.

Again referring to FIG. 1, snaps 18 are preferably disposed at upper right and left corners 30, 32 of base panel 12. This assures that base panel 12 and one or more removable panels 16 may be neatly arranged to be aligned with and suspended from base panel 12 when one or more removable panels 16 are fastened to base panel 12. This arrangement satisfies aesthetic and practical purposes, such as compactness of a bib 10 having many panels 16. Base panel 12 has an outer profile, or configuration taken in front elevation, as shown in FIG. 1, which is similar to or corresponds to that of each removable panel 16. Preferably, the configuration of removable panels 16 include upper left and right corners 34, 36 corresponding to corners 32, 30 (respectively) of base panel 12. In a manner similar to base panel 12, fasteners 20 are disposed at corners 34, 36.

Optionally, a flexible tab 38 fixed to base panel 16 is disposed to cover the outer or front fastener of removable panel 16 when removable panel 16 is fastened to base panel 12. Tab 38 has a fastener such as snap 40 matingly compatible with the outer or front fastener of panel 16. Tab 38 may thus be closed over and fastened to the outermost one of plural removable panels 16 fastened in stacked fashion to base panel 12.

The present invention is susceptible to variations and modifications which may be introduced without departing from the inventive concept. For example, snaps 18 and 20 may be replaced by hook and loop material (not shown), or other well known fasteners if desired. If hook and loop material is employed, then a first fastener corresponding to a snap 18 and the outer fastener disposed on the front side of each removable panel 16 corresponding to the male members 22 of each snap 20 would bear hook and loop material of one polarity, and the inner fastener disposed on the rear side of each removable panel 16 corresponding to socket 24 of each snap 20 and a fastener corresponding to fastener of tab would comprise hook and loop material of opposite polarity.

In a further modification, two spaced apart fasteners equivalent to snaps 18 could be replaced by a single broad fastener (not shown) spanning the two points occupied by snaps 18 of FIG. 1. This alternative embodiment would be most feasible if the fastener were hook and loop fastening material or a zipper (not shown). Similarly, a removable panel 16 could be provided with a single broad fastener (not shown).

Figure 4:
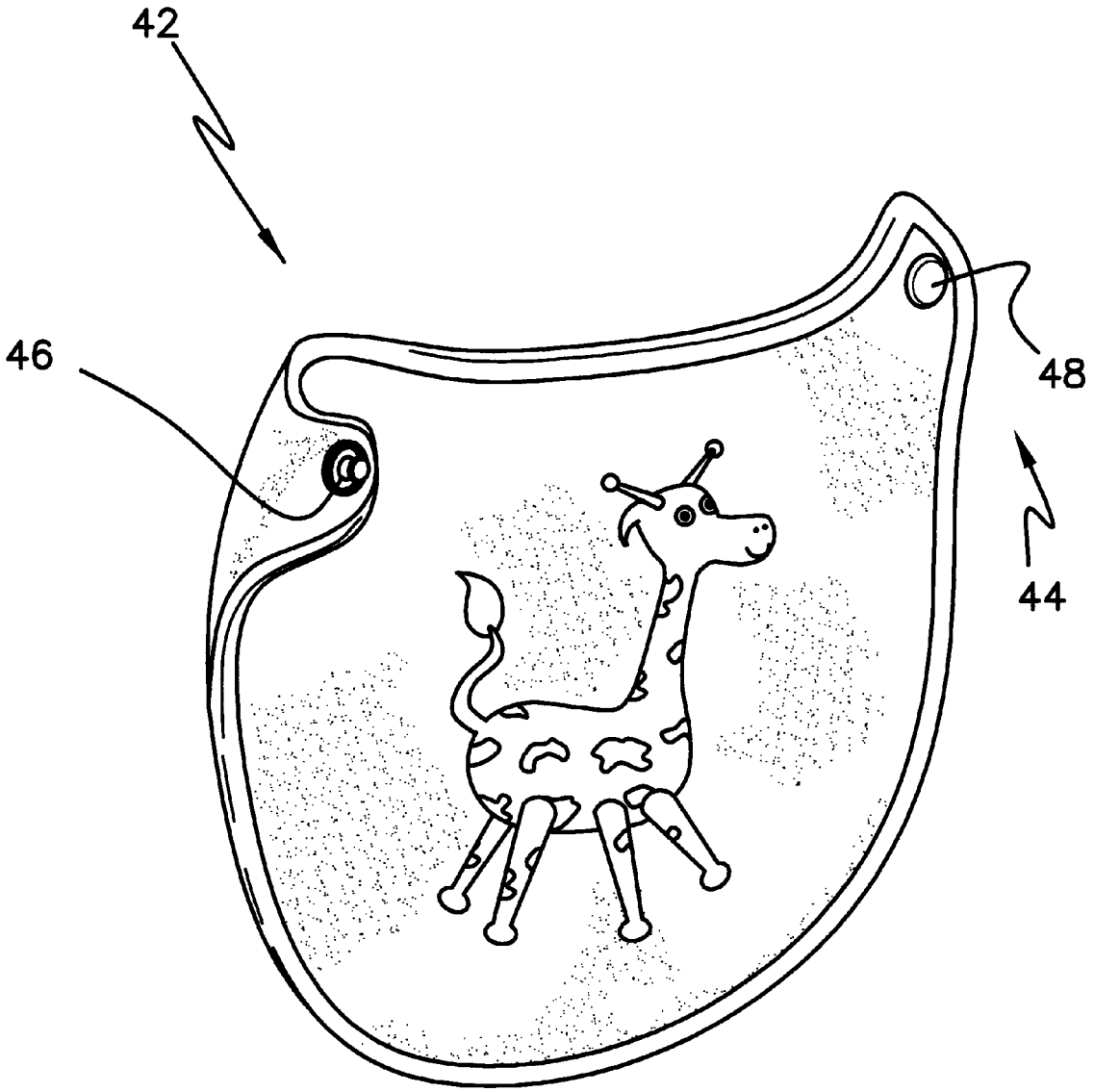
FIG. 4 is a front perspective view of a protective panel of an alternative embodiment.

As an alternative to tab 38 of the embodiment of FIG. 1, and referring now to FIG. 4, bib 10 may be provided with a top removable panel 42. Top removable panel 42 has snaps 44 which include a female receptacle 46 on one side and have a finished surface 48 on the other side. A finished surface is unencumbered by snap connection structure, and presents a polished, painted, or other finished appearance to the observer.

Still other variations and modifications may be provided.

It is to be understood that the present invention is not limited to the embodiments described above, but encompasses any and all embodiments within the scope of the following claims.

I claim:

1. A bib having readily removable protective panels, comprising:

a base panel of flexible material having a front side and a rear side, said base panel having a first fastener disposed on said front side of said base panel;

a tie fastened to said base panel, for securing said bib to the neck of a wearer; and at least one removable panel of flexible, liquid absorbent material, said removable panel having a front side, a rear side, a second fastener fastenably compatible with said first fastener, and a third fastener configured similarly to said first fastener, said second fastener and said third fastener disposed in overlying relationship, whereby a plurality of removable panels may be fastened to said base panel in stacked fashion and are individually removable from other said removable panels and from said base panel, a flexible tab fixed to said base panel and disposed to cover said third fastener when a said removable panel is fastened to said base panel, said tab having a fourth fastener matingly compatible with said third fastener, whereby said tab may be closed over and fastened to the outermost one of plural removable panels fastened in stacked fashion to said base panel.

2. The bib according to claim 1, said base panel having two said first fasteners horizontally spaced apart from one another, and each said removable panel having two said second fasteners and two said third fasteners, said second fasteners and said third fasteners of each one said removable panel being horizontally spaced apart from one another by a distance equal to that separating said two first fasteners, whereby said removable panels may be suspended fully spread open when fastened to said base panel.

3. A bib having readily removable protective panels, comprising:

a base panel of flexible material having a front side and a rear side, said base panel having a first fastener disposed on said front side of said base panel;

a tie fastened to said base panel, for securing said bib to the neck of a wearer; and at least one removable panel of flexible, liquid absorbent material, said removable panel having a front side, a rear side a second fastener fastenably compatible with said first fastener, and a third fastener configured similarly to said first fastener, said second fastener and said third fastener disposed in overlying relationship, whereby a plurality of removable panels may be fastened to said base panel in stacked fashion and are individually removable from other said removable panels and from said base panel, and a top protective panel having a fifth fastener having fastening structure fastenably compatible with said first fastener on one side of said top protective panel, and said fifth fastener having a finished surface unencumbered by fastening structure, said finished surface disposed upon the other side of said top protective panel.

4. A bib having readily removable protective panels, comprising:

a base panel of flexible material having a front side and a rear side, said base panel having a first fastener disposed on said front side of said base panel;

a tie fastened to said base panel, for securing said bib to the neck of a wearer;

a plurality of removable panels of flexible, liquid absorbent material, each said removable panel having a front side, a rear side, a second fastener fastenably compatible with said first fastener, and a third fastener configured similarly to said first fastener, said second fastener and said third fastener disposed in overlying relationship, whereby said removable panels may be fastened to said base panel in stacked fashion and are individually removable from other said removable panels and from said base panel, said base panel having two said first fasteners horizontally spaced apart from one another, and each said removable panel having two said second fasteners and two said third fasteners, said second fasteners and said third fasteners of each one said removable panel being horizontally spaced apart from one another by a distance equal to that separating said two first fasteners, whereby said removable panels may be suspended fully spread open when fastened to said base panel, said base panel having a profile, an upper right corner, and an upper left corner, one of said first fasteners disposed at said upper right corner and the other of said first fasteners disposed at said upper left corner, and each said removable panel having a profile corresponding to said profile of said base panel, an upper right corner and an upper left corner disposed in overlying relationship to said upper right corner of said base panel when said removable panel is fastened to said base panel and an upper left corner disposed in overlying relationship to said upper left corner of said base panel when said removable panel is fastened to said base panel, whereby each said removable panel is aligned with and suspended from said base panel when said removable panel is fastened to said base panel; and a top protective panel having a fifth fastener having fastening structure fastenably compatible with said first fastener on one side of said top protective panel, and said fifth fastener having a finished surface unencumbered by fastening structure, said finished surface disposed upon the other side of said top protective panel.

5. The bib according to claim 4, said first fastener comprising a snap, and said second fastener and said third fastener comprising two sided snaps, each one of said second fastener and said third fastener including one male snap and one female snap.

6. The bib according to claim 4, said first fastener, said second fastener, and said third fastener all comprising hook and loop material, said first fastener and said third fastener being of like polarity, and said second fastener being of polarity opposite that of said first fastener and said second fastener.

7. The bib according to claim 4, further comprising a flexible tab fixed to said base panel and disposed to cover said third fastener when a said removable panel is fastened to said base panel, said tab having a fourth fastener matingly compatible with said third fastener, whereby said tab may be closed over and fastened to the outermost one of plural removable panels fastened in stacked fashion to said base panel.

* * * * *